US007066851B1

(12) United States Patent
Poruchny

(10) Patent No.: US 7,066,851 B1
(45) Date of Patent: Jun. 27, 2006

(54) FLOOR HOCKEY PUCK

(76) Inventor: Mark Poruchny, 13940 Chief Lake Road, Prince George, B.C. (CA) V2K 5K1

( * ) Notice: Subject to any disclaimer, the term of this patent is extended or adjusted under 35 U.S.C. 154(b) by 0 days.

(21) Appl. No.: 11/011,129

(22) Filed: Dec. 15, 2004

(51) Int. Cl.
*A63B 67/00* (2006.01)

(52) U.S. Cl. ..... 473/588; 473/589

(58) Field of Classification Search ..... 473/588, 473/589; 15/230.12
See application file for complete search history.

(56) References Cited

U.S. PATENT DOCUMENTS

| | | | | |
|---|---|---|---|---|
| 2,494,929 | A * | 1/1950 | Colaluca | 473/588 |
| 3,887,188 | A | 6/1975 | Beauchamp et al. | |
| 4,437,271 | A * | 3/1984 | McAvoy | 451/532 |
| 4,754,973 | A | 7/1988 | Kunick | |
| 4,878,668 | A | 11/1989 | Nevoral | |
| 5,240,251 | A | 8/1993 | Filice | |
| 5,676,376 | A * | 10/1997 | Valley | 273/288 |
| 6,089,998 | A * | 7/2000 | O'Neal et al. | 473/588 |
| 6,488,210 | B1 * | 12/2002 | Schumi et al. | 235/488 |
| 2005/0130775 | A1 * | 6/2005 | Hylak | 473/588 |

FOREIGN PATENT DOCUMENTS

| | | |
|---|---|---|
| CA | 2008992 | 7/1991 |
| CA | 1315818 | 4/1993 |
| CA | 2145825 | 6/2000 |

* cited by examiner

*Primary Examiner*—Raleigh W. Chiu
(74) *Attorney, Agent, or Firm*—Russell reyneke Law Corp.; Elbie R. de Kock

(57) ABSTRACT

A floor hockey puck comprises a pair of felt discs bonded together by means of a flexible adhesive sandwiched between the discs forming a core which acts as a weight element to import sufficient weight to the puck to approximate the movement of an ice hockey puck on ice.

10 Claims, 2 Drawing Sheets

FLOOR HOCKEY PUCK

FIELD OF THE INVENTION

This invention relates to a floor hockey puck, i.e. a puck which is intended mainly for use on a non-ice surface, such as a wooden floor, and a method of manufacturing such a puck.

BACKGROUND OF THE INVENTION

In order to simulate ice hockey, a floor hockey puck should be of a suitable material and have a suitable weight to sustain the dynamics of an ice hockey game, e.g. so that its movement across a floor will approximate the movement of an ice hockey puck on ice.

Floor hockey pucks have been made of a plastic material. However, these pucks do not properly simulate the motion of an ice hockey puck and since they are non-deformable and hard can cause severe injury when hitting a player.

Floor hockey pucks have also been manufactured of a softer material, such as felt, but the problem that arises is that the puck is too light to simulate an ice hockey puck. In an attempt to increase the weight, a ballast weight has been embedded in the centre of the puck. For example, U.S. Pat. No. 3,887,188 describes a puck comprising a one-piece body of felt with a ballast weight located centrally within the felt body. The problem however is that with the hitting of the puck during play, the weight works itself out of the centre of the puck, causing erratic movement of the puck.

Canadian Patent No. 2,008,992 describes an indoor hockey puck comprising a felt core provided with a leather skin for sliding on the floor. The leather skin also serves to provide the puck with the required weight to approximate a normal hockey puck. A disadvantage of the puck, however, is that it requires stitching to hold the components of the puck together. The stitching complicates the manufacture of the puck and results in increased cost so that the puck cannot be economically reproduced.

U.S. Pat. No. 4,878,668 also describes an indoor hockey puck comprising a felt core. In this case, the core is sandwiched between a pair of leather discs. Again, the components of the puck are held together by stitching.

Canadian Patent No. 1,315,818 describes a floor hockey puck comprising a circular disc of felt. Again, stitching is involved. In this case the purpose of the stitching is to import a convex shape to the cylindrical edge of the puck to minimize the tendency of the puck to roll on its edge and to assist the felt in holding its shape.

It is an object of the present invention to provide an indoor hockey puck having a suitable weight to approximate the movement of an ice hockey puck on ice and, at the same time, avoids the use of stitching in its manufacture.

SUMMARY OF THE INVENTION

According to one aspect of the invention there is provided a floor hockey puck comprising at least two circular felt discs bonded together in a coaxial relationship by a layer of flexible adhesive sandwiched between the discs to form a composite disc having a pair of opposite circular surfaces and a cylindrical side surface extending between the circular surfaces. The puck preferably further comprises a strip of protective material extending around the cylindrical side surface.

In this specification the term "felt" also includes any suitable natural or synthetic material having a coefficient of friction substantially equal to or less than that of felt.

The flexible adhesive may comprise a rubber cement or a contact cement or any suitable non-hardening adhesive, such as a rubber adhesive.

According to another aspect of the invention the felt discs may be annular in shape, the composite disc having an outer cylindrical side surface and an inner cylindrical side surface extending between said opposite circular surfaces, further comprising a strip of protective material extending around the inner cylindrical side surface.

According to a further aspect of the invention there is provided a method of manufacturing a floor hockey puck comprising the step of bonding a pair of felt discs together in a coaxial relationship by means of a flexible adhesive sandwiched between the discs to form a flexible core between the discs.

The method preferably further includes the step of applying a strip of protective material around the discs.

Further objects and advantages of the invention will become apparent from the description of preferred embodiments of the invention below.

BRIEF DESCRIPTION OF THE DRAWINGS

The invention is now described, by way of example only, with reference to the accompanying drawings in which.

DETAILED DESCRIPTION OF THE PREFERRED EMBODIMENTS

Figure 1:
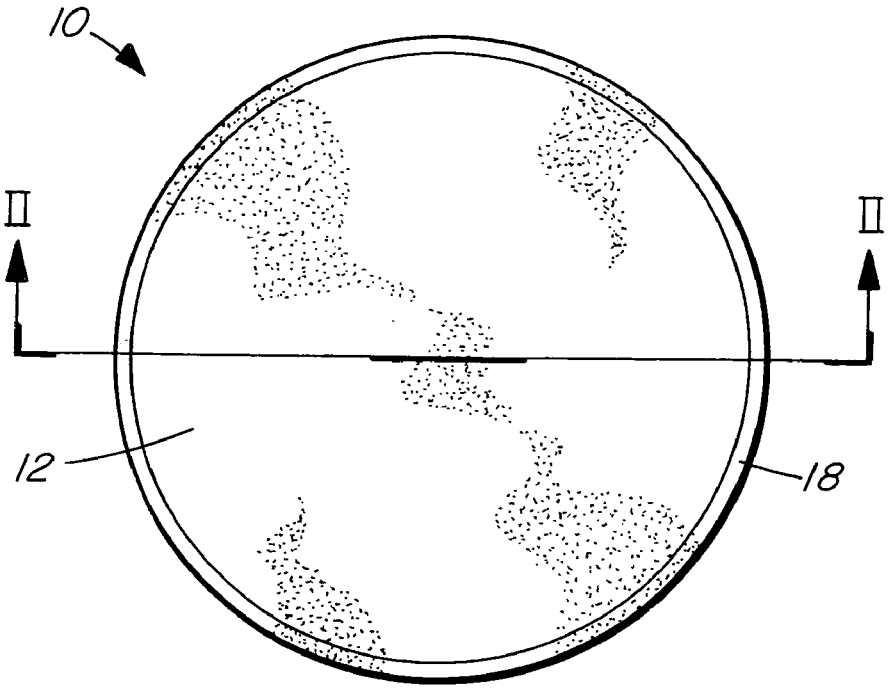
FIG. 1 is a plan view of an indoor hockey puck according to the invention.
Figure 2:
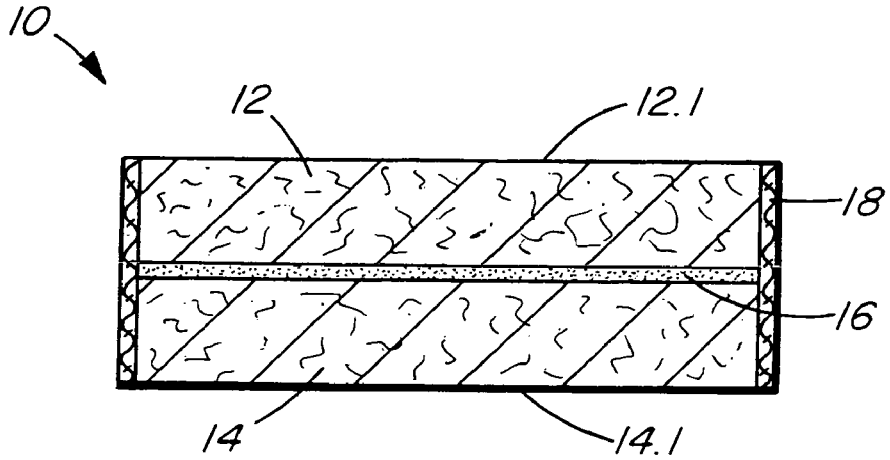
FIG. 2 is a cross-section of the puck along the lines II—II in FIG. 1.

In FIGS. 1 and 2, reference numeral 10 generally indicates an indoor hockey puck comprising a pair of felt discs 12 and 14 with a core 16 of flexible adhesive or rubber material, e.g. contact cement, sandwiched between the discs.

The discs 12 and 14 may be of a commercial felt material or any other suitable felt material.

The inventor has found that the weight of a felt puck can be sufficiently increased in order to approximate the movement of an ice hockey puck on ice, by providing the puck with a core of a flexible adhesive. Therefore, the core 16 serves a dual purpose, i.e. it serves as a weight element to impart the required weight to the puck 10, as well as bonding the discs 12 and 14 to one another.

The discs 12 and 14 have circular surfaces 12.1 and 14.1, respectively, which during use of the puck 10 slide across the floor.

A strip 18 of protective material, such as a fabric or natural leather or synthetic leather, extending around the discs 14 and 16, is provided. The same flexible adhesive used for providing the core 16 can be used for bonding the strip 18 to the felt discs 12 and 14. In this way, the adhesive serving to bond the strip 18 to the discs 12 and 14 also contributes to the weight of the puck 10 and serves as an additional weight element.

As can be seen, the width of the strip 18 is equal to the thickness of the puck 10 so that the opposite edges of the strip 18 are flush with the circular felt surfaces 12.1 and 14.1.

A method of manufacture of the puck 10 will now be described by way of example below.

The discs 12 and 14 are pressed out of a felt or felt-like material of approximately ⅝ (five eighths) inch (1.6 cm) thick. The diameter of the discs 12 and 14 is approximately 3 1/16 (three and one sixteenth) of an inch (7.8 cm).

The density of the felt material being used will also affect the weight of the resulting puck, i.e. the denser the material, the heavier the puck and vice versa. Therefore, the density of the felt material can be selected in combination with the amount of adhesive in the core 16 and the amount of the adhesive (if used) bonding the strip 18 to the discs 12 and 14, to result in a desired weight of the resulting puck.

In order to form the core 16, the adhesive is applied to one side of each of the felt discs 12 and 14, the amount of adhesive applied being determined by the desired weight of the resulting puck, as indicated above. If desired, more than one coat, e.g. two or three coats, of the adhesive can be applied, the previous coat being allowed to dry before the next coat is applied.

Once the adhesive or last coat of adhesive, if more than one coat is applied, has set (become tacky) on the surfaces of the discs 12 and 14 (typically, after about 20 minutes), the discs 12 and 14 are pressed together in a coaxial fashion so that their cylindrical edges are in alignment, i.e. a composite disc of about twice the thickness of each of the discs 12 and 14 is formed. Pressure is applied to the opposite surfaces 12.1 and 14.1, e.g. by clamping the composite disc in a vice with light pressure so that the discs 12 and 14 are slightly compressed. This is to allow the adhesive to dry without the felt discs 12 and 14 expanding. The minimum drying time under pressure is about 30 minutes.

The flexible adhesive does not harden when it has dried, i.e. it remains flexible and does not become rigid. Examples of flexible adhesive that may be used are products available under the trade names LEPAGES and TEN BOND contact cement.

After the adhesive has dried to form the core 16 bonding the discs 12 and 14 together, the protective strip 18 is applied.

The strip 18 is cut in a length of approximately 11 inches (28 cm) and wide enough to extend over the cylindrical surface of the composite disc. The thickness of the composite disc may vary slightly depending on the amount of adhesive applied to form the core 16 but the strip 18 is usually approximately 1⅛ (one and one eighth) inch (2.9 cm) wide.

The adhesive is applied, e.g. with a brush, to the cylindrical surface of the composite disc, as well as to the one (inner) side of the strip 18.

As mentioned above, the amount of adhesive applied will also affect the weight of the resulting puck 10 and the amount of adhesive can be increased or decreased depending on the required weight. However, it should be noted that a different bonding agent than the adhesive used for the core 16 may be used, which may be lighter and therefore not contribute significantly to the weight of the resulting puck.

After the adhesive is allowed to dry for about 30 minutes, the strip 18 is applied to the cylindrical surface of the composite disc by placing one end (leading end) of the strip 18 on the cylindrical surface of the composite disc and while keeping the opposite edges of the strip 18 aligned with the sides 12.1 and 14.1, the strip 18 is attached around the circumferential surface of the composite disc. When the leading end of the strip 18 is reached, the other end (trailing end) is cut to a desired length so that the two ends will abut on the circumferential surface of the composite disc.

It should be borne in mind that while this example has been described using two discs 12 and 14, a greater number of discs, such as three or more may be used with an adhesive core, such as the core 16, provided between each adjacent pair of discs.

The puck 10 may be provided in different weights, e.g. a lighter junior or beginner model and a heavier master model.

In manufacturing the junior model, a lighter density felt may be used in combination with a lesser amount of adhesive in the core 16, while a higher density felt in combination with a greater amount of adhesive in the core is used for the master model.

The weight of the junior model may be from 40 to 60 g, while the weight of the master model is at least 60 g.

Figure 3:
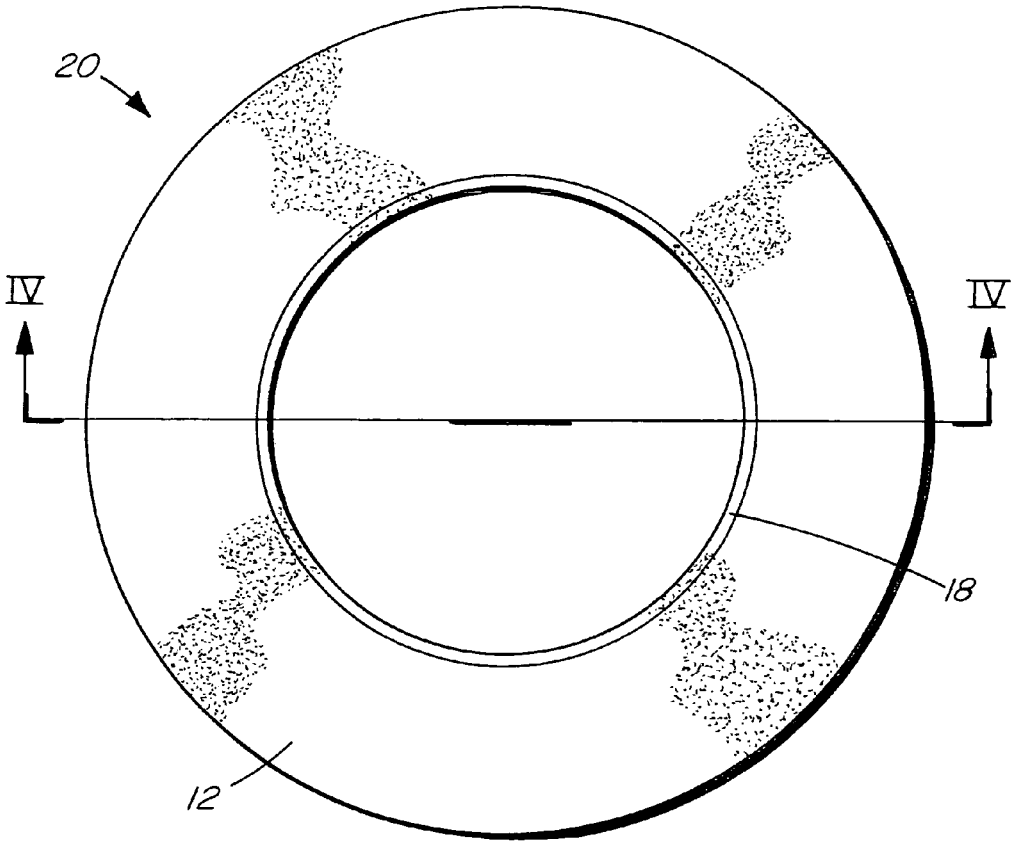
FIG. 3 is a plan view of an indoor hockey puck according to another aspect of the invention.
Figure 4:
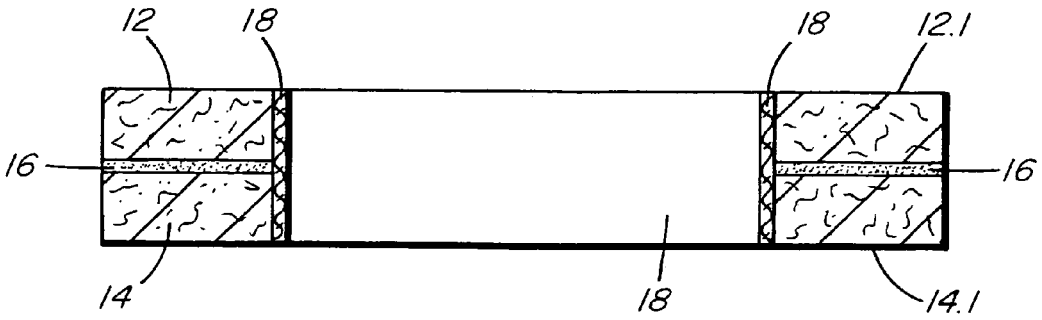
FIG. 4 is a cross-section of the puck taken along the lines IV—IV in FIG. 3.

Referring now to FIGS. 3 and 4 and indoor hockey puck 20 in the form of a ring or annulus is shown, which can be used for playing ringette hockey.

The puck 20 is manufactured in similar fashion as the puck 10 and like parts are indicated by like reference numerals.

The puck 20 comprises a pair of felt discs 12 and 14. In this case, the discs 12 and 14 have central circular cut-outs, so that they are in the form of annular members or rings.

As in the case of the puck 10, the discs or rings 12 and 14 are bonded together by a core 16 flexible adhesive.

The puck or ring 20 is also provided with a strip 18 of protective material but this time it is located around the inner cylindrical surface, which is where the ring 20 will be contacted with a stick during play of the game.

Typically the ring 20 has an outer diameter of about 6⅜ inches (16.2 cm) and an inner diameter of about 4⅛ inches (10.5 cm). The thickness of the puck 20 is about 1¼ inch (3.2 cm).

Although certain preferred embodiments of the present invention have been shown and described in detail, it should be understood that various changes and modifications may be made therein without departing from the scope of the appended claims.

I claim:

1. A floor hockey puck comprising at least two circular felt discs bonded together in a coaxial relationship by a layer of flexible adhesive sandwiched between the discs to form a composite disc having a pair of opposite circular surfaces and a cylindrical side surface extending between the circular surfaces and a strip of protective material extending around the cylindrical side surface.

2. The puck according to claim 1, wherein the flexible adhesive comprises a rubber cement or a contact cement.

3. The puck according to claim 1, wherein the protective material is selected from the group consisting of a fabric, natural leather and synthetic leather.

4. The puck according to claim 1, wherein the strip of protective material is bonded to the cylindrical surface by means of a bonding agent.

5. The puck according to claim 4, wherein the bonding agent comprises said flexible adhesive.

6. A floor hockey puck comprising at least two circular felt discs bonded together in a coaxial relationship by a layer of flexible adhesive sandwiched between the discs to form a composite disc having a pair of opposite circular surfaces, wherein the felt discs are annular in shape, the composite disc having an outer cylindrical side surface and an inner cylindrical side surface extending between said opposite circular surfaces, further comprising a strip of protective material extending around the inner cylindrical side surface.

7. The puck according to claim 6, wherein the flexible adhesive comprises a rubber cement or a contact cement.

8. The puck according to claim 6, wherein the protective material is selected from the group consisting of a fabric, natural leather and synthetic leather.

9. The puck according to claim 6, wherein the strip of protective material is bonded to the inner cylindrical side surface by means of a bonding agent.

10. The puck according to claim 9, wherein the bonding agent comprises said flexible adhesive.

* * * * *